United States Patent [19]

Carson et al.

[11] Patent Number: 4,660,872

[45] Date of Patent: Apr. 28, 1987

[54] LATCH

[75] Inventors: Ernest A. Carson, San Pedro; Gordon K. Anderson, Tustin, both of Calif.

[73] Assignee: Carrier Corporation, Syracuse, N.Y.

[21] Appl. No.: 806,987

[22] Filed: Dec. 9, 1985

[51] Int. Cl.[4] ..... E05C 9/08

[52] U.S. Cl. ..... 292/242; 292/218; 292/DIG. 68

[58] Field of Search ..... 292/218, 216, 242, 120, 292/DIG. 68, 213, 217, 116, 241

[56] References Cited

U.S. PATENT DOCUMENTS

| | | | |
|---|---|---|---|
| 1,563,880 | 12/1925 | Vance | 292/120 |
| 1,919,328 | 7/1933 | Hansen | 292/218 |
| 2,031,897 | 2/1936 | Luce | 292/242 X |
| 3,039,837 | 6/1962 | Poe | 292/241 X |
| 3,157,420 | 11/1964 | Sulkowski | 292/241 X |
| 3,560,038 | 2/1971 | Gunther | 292/241 |
| 4,134,281 | 1/1979 | Pelcin | 292/218 X |

*Primary Examiner*—Richard E. Moore

*Attorney, Agent, or Firm*—David J. Zobkiw

[57] ABSTRACT

A cammed latch is provided with two spaced cams each of which has a cam profile made up of two arcuate sections separated by a cusp. The cusp portion constitutes an interference fit during opening end closing. The latch structure is resiliently mounted to flanges which flex to permit the striker rods to pass over the cusps. A torsion spring provides a closing bias in all positions of the latch.

5 Claims, 4 Drawing Figures

LATCH

BACKGROUND OF THE INVENTION

The latching of doors such as those providing access to a nose-mounted engine driven trailer refrigeration unit present special problems since the doors are relatively large, subject to vibrational forces associated with highway travel and exposed to weather and highway hazards. The doors are, however, expected to protect the equipment from rain, snow and slush, provide easy access and to remain securely closed.

SUMMARY OF THE INVENTION

The present invention is directed to a cammed latch having two spaced cams. Each of the cam profiles is made up of two arcuate sections separated by a cusp and one of the cams is integral with the latch handle. Except for the striker structure, all of the latch structure is secured to the flanges of the door such that resilient flexure of the flanges is possible to permit an accommodation for misalignment and a bias for holding the doors shut. A torsion spring provides a closing bias directly to the cam which is integral with the latch handle as well as to the other cam through the latch structure.

It is an object of this invention to provide a cammed latch having two cams each of which has a profile including two arcuate portions separated by a cusp.

It is another object of this invention to provide a single door latch for holding two doors closed.

It is a further object of this invention to provide a pair of spaced cams which act as a unit in coacting with their respective striker rods.

It is another object of this invention to provide a spring load on a cam for biasing the cam into engagement with the corresponding striker rod.

It is an additional object of this invention to provide a resilient mounting to permit an accommodation to misalignment and to provide a constant tension in the closed position. These objects, and others as will become apparent hereinafter, are accomplished by the present invention.

Basically, an integral cam and handle member is biased into a closed position by a torsion spring. The integral cam and a second cam are both mounted on a rod having a rectangular cross-section and rotate therewith as a unit and so are all acted on by the spring. The rod is mounted on the door flanges which resiliently flex to permit an accommodation for misalignment and to provide a closing bias in addition to that of the spring.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
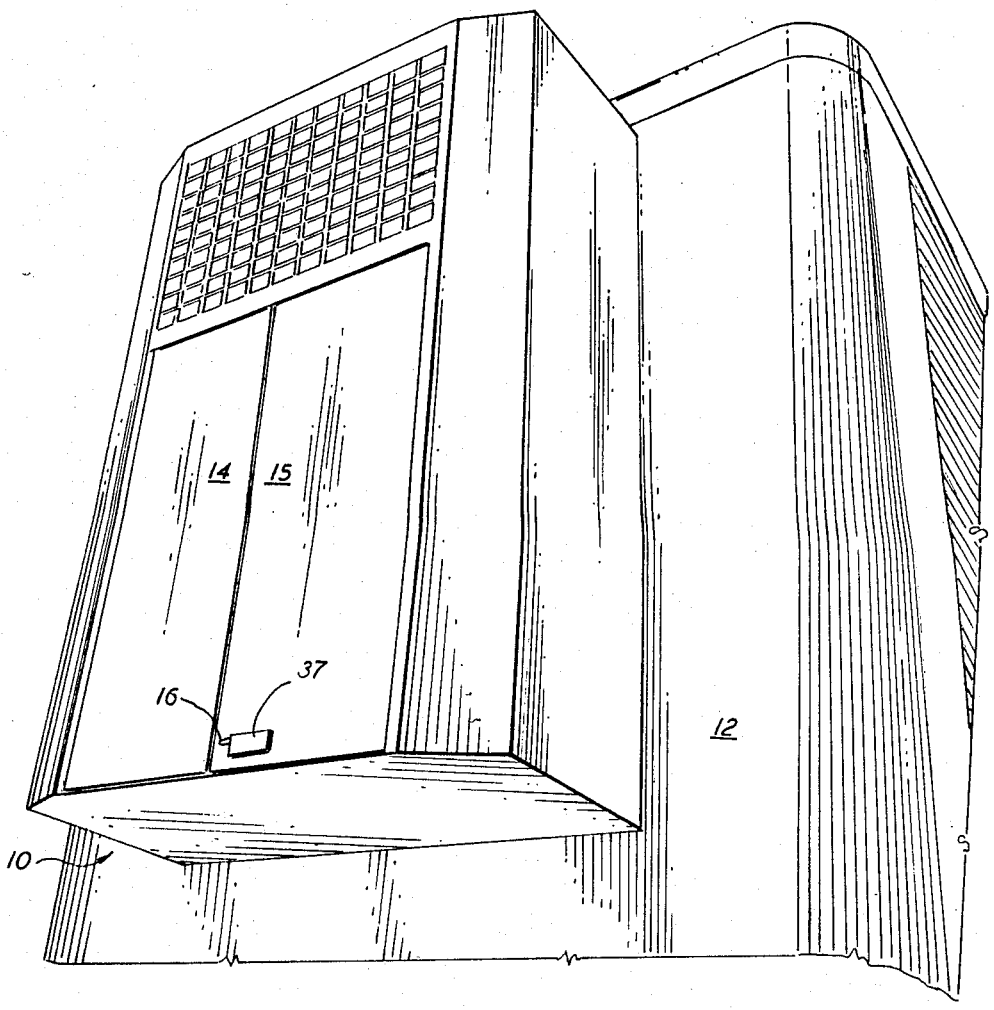
FIG. 1 is a pictorial view of a nose-mounted refrigeration unit employing the present invention.

In FIG. 1, the numeral 10 generally designates a refrigeration unit mounted on trailer 12. The refrigeration unit has a pair of doors 14 and 15 which are vertically hinged at their respective outer edges to provide a large access opening. The only portion of the latch and striker structure which is visible in FIG. 1 is the handle portion 37 of integral paddle latch and cam 36 which extends through slot 16 in door 15.

Figure 2:
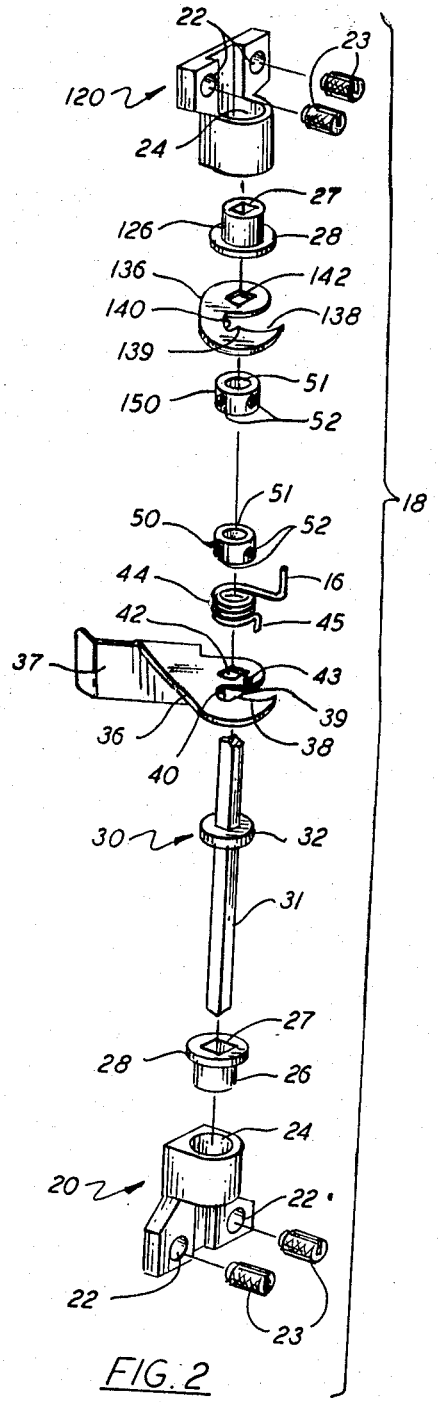
FIG. 2 is an exploded view of the latch structure.
Figure 3:
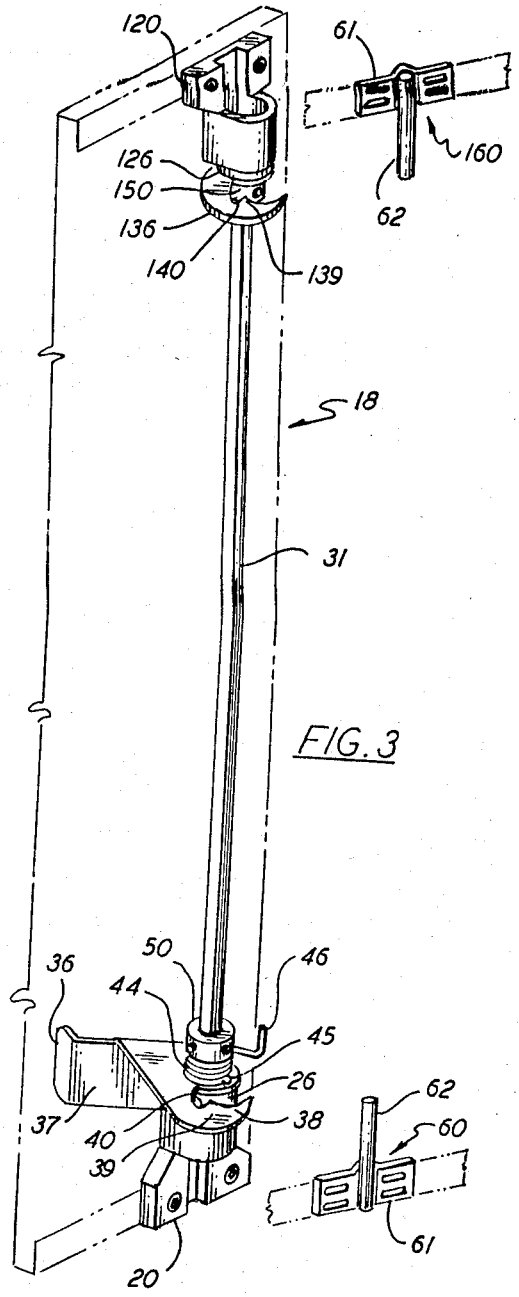
FIG. 3 is a pictorial view of the assembled latch and striker structures showing a portion of the door and cabinet in phantom.

Referring now to FIGS. 2 and 3, a pair of identical mounting bracket bushings 20 and 120 each having a pair of bores 22 for receiving internally threaded press inserts 23 to secure bushings 20 and 120 to door 15, and an axial bore 24 for receiving identical flanged bearings 26 and 126, respectively. Bearings 26 and 126 have a square axial bore 27 for receiving respective end portions of rod assembly 30. Rod assembly 30 includes a square rod 31 with a washer 32 welded thereto such that washer 32 seats on flange 28 of bearing 26 to properly locate the rod assembly 30. Integral paddle latch and cam member 36 has a handle portion 37 and a cam portion made up of arcuate portions 38 and 40 with cusp 39 located therebetween. Arcuate portion 40 defines an open ended slot. A square hole 42 is provided in member 36 for receiving rod 31 so that member 36 rotates as a unit with rod assembly 30. A second hole 43 is provided in member 36 for receiving end 45 of torsion spring 44. The other end, 46, of torsion spring 45 engages the interior of door 15 to provide a closing bias in all positions of latch 18. Collar 50 has a round bore 51 for receiving rod 31 and a pair of set screws 52 spaced 90° apart for non-rotatably securing collar 50 to rod 31 so as to hold spring 45 in place against member 36 which is, in turn, held against washer 32.

Collar 150 is identical to collar 50 and holds cam 136 against flange 28. Cam 136, which is essentially identical to the cam portion of member 36, has two arcuate portions 138 and 140 with cusp 139 located therebetween. Arcuate portion 140 defines an open ended slot. A square hole 142 is provided in cam 136 for receiving rod 31 so that cam 136 rotates as a unit with rod assembly 30.

Figure 4:
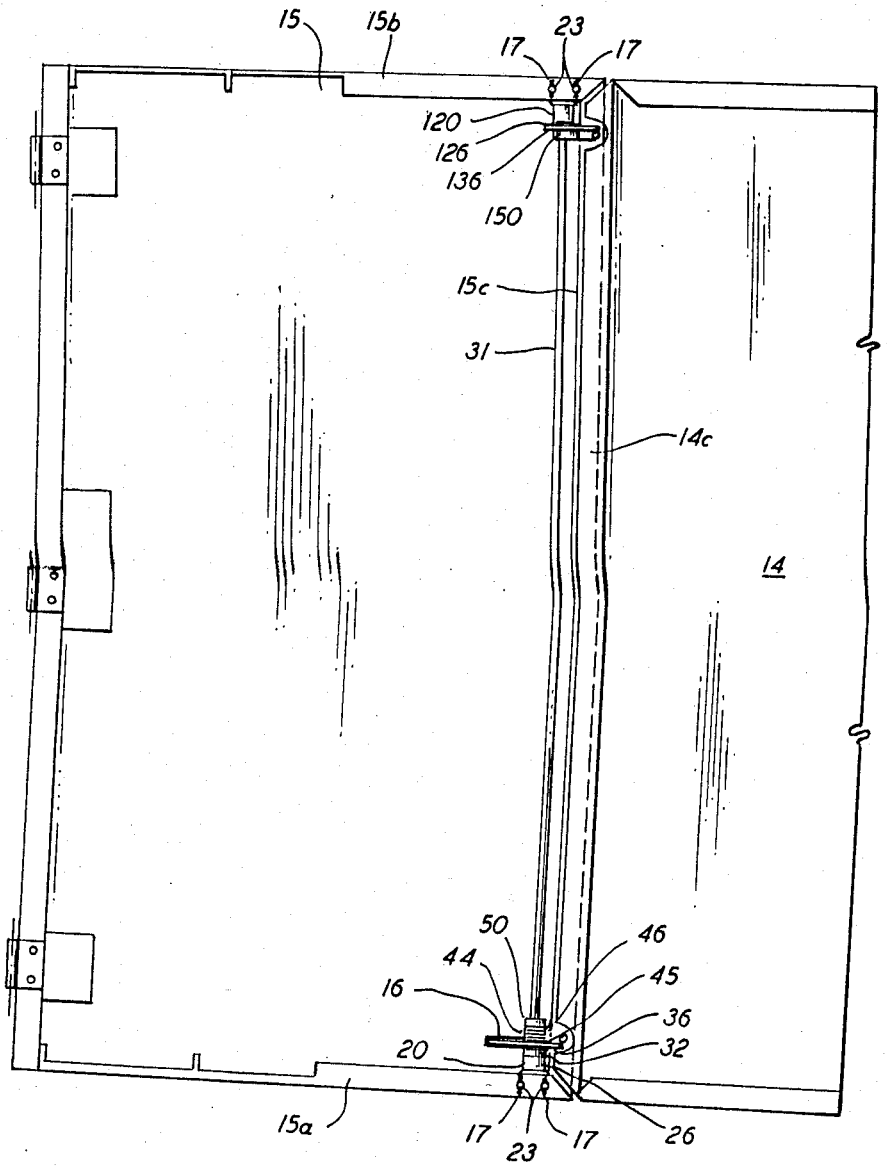
FIG. 4 is a partially cutaway view of a latched door viewed from the interior of the compartment.

Referring specifically to FIG. 3, each of the striker structures 60 and 160 includes a formed plate 61 with a striker rod 62 welded thereto. The striker structures 60 and 160 are suitably secured to the frame of the refrigeration unit 12 which is shown in phantom. Latch 18 is secured to door 15 which is shown in phantom and ajar. Referring now specifically to FIG. 4, it will be seen that mounting bracket bushings 20 and 120 are, respectively, adjustably secured to flanges 15*a* and *b* of door 15 by internally threaded press inserts 23 which are received in slots 17. Thus, attachment of the latch 18 is at the area of greatest strength, the flanged peripheral edges of the door. Further, it will be noted that flange 15*c* of door 15 overlies flange 14*c* of door 14 so that latch 18 serves to hold both of doors 14 and 15 closed.

In operation, when paddle latch and cam member 36 is rotated, it causes the simultaneous rotation of bearings 26 and 126, rod assembly 30, cam 136, collars 50 and 150 and end 45 of spring 44 relative to the door 15 upon which they are mounted. End 46 remains in engagement with the door 15 to establish the additional torsion retrun force produced in response to the rotation of end 45 of the spring during the opening movement of the handle 37 of cam member 36. When door 15 is unlatched, the opening, clockwise, rotation of handle 37 therefore positions cam member 36 and cam 136 such that the outer ends of arcuate cam portions 38 and 138 cam against striker rods 62 of strikers 60 and 160, respectively, as door 15 is pushed closed. Striker rods 62 cam against arcuate cam portions 38 and 138 until resistance to the closing movement of door 15 is caused by approaching peaked sections 39 and 139, respectively, since there is an interference fit. The operator then urges handle 37 forward, counterclockwise, overcoming the tension placed due to engagement of the striker rods 62 and the peaked sections 39 and 139. Because latch structure 18 is secured to door 15 only at flanges 15*a* and *b*, the flanges 15*a* and *b* resiliently flex to permit the passage of striker rods 62 past the interference fit producing peaked sections 39 and 139 so that they then engage arcuate cam portions 40 and 140.

With this cam configuration, when door 15 is closed, the latch 18 is held in place even if an attempt is made to pull handle 37 out clockwise, since a pronounced additional force is required to move strikers 62 from the slots defined by arcuate cam portions 40 and 140 over peaked sections 39 and 139. Because spring 44 provides a spring bias opposing an opening movement of the latch 18, an additional force is required to unlatch door 15 and a closing bias is provided if the latch 18 is inadvertently left in the partially cammed position where strikers 62 are in engagement with arcuate cam portions 38 and 138. As a result, the present invention overcomes the problem of accidental opening and allows extended lateral alignment tolerance with respect to the strikers 62 and the slot shaped apertures defined by arcuate cam positions 40 and 140. Even if the spring breaks, this lateral alignment tolerance is unaffected.

Flanged bearings 26 and 126 are preferably made of nylon or polyethylene and integral paddle latch end cam member 36 and cam 136 are preferably made of vinyl coated stainless steel. The other members are made of any suitable material such as steel, stainless steel and zinc coated stainless steel.

Although a preferred embodiment of the present invention has been illustrated and described, other change will occur to those skilled in the art. It is, therefore, intended that the present invention be limited only by the scope of the appended claims.

What is claimed is:

1. A latch comprising:

first and second striker means;

a door having a top and a bottom and pivotably mounted with respect to said first and second striker means so as to be able to have said top and said bottom move towards and away from said first and second striker means, respectively;

a slot formed in said door;

rod means having a first and a second end;

mounting means for supporting said first and second ends of said rod means on said door;

first cam means having a pair of arcuate sections separated by a cusp for coacting with said first striker means and having a handle integral therewith which extends through said slot;

second cam means having a pair of arcuate sections separated by a cusp for coacting with said second striker means; and means for spacedly locating said first and second cam means on said rod means such that movement of said handle in said slot causes said rod means and said first and second cam means to move therewith as a unit, such that said first one of said pairs of arcuate sections of said first and second cam means respectively engage said first and second striker means to hold said door in place and upon flexure of said door said cusps of said first and second cam means are able to move past said first and second striker means such that said first and second striker means are respectively in engagement with a second one of said pairs of arcuate sections of said first and second cam means to securely hold said door in place.

2. The latch of claim 1 further including bearing means supporting said first and second ends of said rod means in said mounting means and moving with said rod means as a unit.

3. The latch of claim 1 further including torsion spring means surrounding said rod means and coacting with said door and said first cam means for biasing said first cam means towards a closing position.

4. A latch comprising:

first and second striker means;

a door having a top, a bottom and flanges and pivotably mounted with respect to said first and second striker means so as to be able to have said top and said bottom move towards and away from said first and second striker means, respectively;

a slot formed in said door;

rod means having a polygonal cross-section and a first and a second end;

bearing means for receiving said first and second ends;

mounting means for receiving said bearing means and mounted on said flanges of said door;

first cam means having a pair of arcuate sections separated by a cusp for coacting with said first striker means and having a handle integral therewith which extends through said slot and a polygonal hole for receiving said rod means;

second cam means having a pair of arcuate sections separated by a cusp for coacting with said second striker means and a polygonal hole for receiving said rod means; and means for spacedly locating said first and second cam means on said rod means such that movement of said handle in said slot causes said rod means and said first and second cam means to move therewith as a unit, such that said first one of said pairs of arcuate sections of said first and second cam means respectively engage said first and second striker means to hold said door in place and upon flexure of said door said cusps of said first and second cam means are able to move past said first and second striker means such that said first and second striker means are respectively in engagement with a second one of said pairs of arcuate sections of said first and second cam means to securely hold said door in place.

5. The latch of claim 4 further including torsion spring means surrounding said rod means and coacting with said door and said first cam means for biasing said first cam means towards a closing position whereby said door may be held closed when said striker means are engaging either one of said arcuate sections of said pairs of arcuate sections.

* * * * *